US006678958B1

(12) United States Patent
Budrow

(10) Patent No.: US 6,678,958 B1
(45) Date of Patent: Jan. 20, 2004

(54) UTILITY KNIFE WITH BLADE STORAGE

(75) Inventor: William B. Budrow, Long Beach, CA (US)

(73) Assignee: AWI Acquisition Company, Sylmar, CA (US)

( * ) Notice: Subject to any disclaimer, the term of this patent is extended or adjusted under 35 U.S.C. 154(b) by 23 days.

(21) Appl. No.: 10/137,206

(22) Filed: May 1, 2002

(51) Int. Cl.[7] ..... B26B 1/08
(52) U.S. Cl. ..... 30/125; 30/162; 30/335
(58) Field of Search ..... 30/125, 162, 335

(56) References Cited

U.S. PATENT DOCUMENTS 3,577,637 A * 5/1971 Braginetz ..... 30/162
5,495,670 A * 3/1996 Quinn ..... 30/162
5,613,300 A * 3/1997 Schmidt ..... 30/125
5,966,817 A * 10/1999 Lee ..... 30/162
6,192,589 B1 * 2/2001 Martone et al. ..... 30/125
6,314,646 B1 * 11/2001 Schmidt ..... 30/162

* cited by examiner

*Primary Examiner*—Hwei-Siu Payer
(74) *Attorney, Agent, or Firm*—Jack C. Munro

(57) ABSTRACT

A utility knife which has a blade of usage which is extendable from an extended/usage position to a retracted/storage position. The housing of the utility knife includes a blade storage compartment within which is mounted a blade dispenser. The blade dispenser is designed to hold a stack of replacement knife blades. The blade dispenser is movable between a closed and an open position, and when in the closed position the blade dispenser is confined within the housing of the utility knife, and when in the open position a single replacement blade can be removed to be substituted for the blade of usage that is mounted in a position for usage within the utility knife.

1 Claim, 1 Drawing Sheet

10
12
14
16
18
20
22
24
26
28
30
32
34
36
38
40
42
44
46
48
50
52
54
56
58
60
2

UTILITY KNIFE WITH BLADE STORAGE

BACKGROUND OF THE INVENTION

1. Field of the Invention

The field of this invention relates to hardware type of tools and more specifically to a utility knife which includes a stack of replaceable knife blades.

2. Description of the Related Art

A utility knife is a tool that is commonly used by tradesmen. The typical construction of a utility knife comprises an elongated housing which is capable of being comfortably held in a user's hand. There is a knife blade known as blade of usage that is connected to a manually operated actuator. Movement of the actuator to a forward position will cause the blade of usage to be extended from the housing of the utility knife. The blade of usage can then be used for the purpose of cutting paper, wood and other similar materials. By moving the actuator to a rear position will result in the blade of usage being retracted within the housing so as to not be exposed during periods of non-usage which could cause the blade to accidentally injure someone or cause damage to an object.

The blade of usage of a utility knife will generally become dull after a period of usage. Also, the blade of usage is capable of being broken. It is necessary to replace a dull blade or a broken blade with a new blade of usage. For this purpose, it is common to associate with a utility knife a stack of replacement blades. These replacement blades are frequently contained within a storage chamber and there is even provision in some utility knives for the replacement blade to be installed automatically by operation of the actuator to affect movement of the blade of usage between a retracted position and the extended position. A lower cost of manufacturing can be experienced if the utility knife could be constructed to include a stack of replacement blades but where the stack is not dispensed automatically but is dispensed manually.

SUMMARY OF THE INVENTION

The first embodiment of the present invention utilizes a utility knife with a blade storage where there is a blade of usage mounted within the housing of the utility knife and this blade of usage is locatable in either an extended position from the housing, which is the position of usage, or located in a retracted position which is the storage position. Included within the housing is a blade storage compartment. Included within the blade storage compartment is a blade dispenser with the blade dispenser being designed to hold a stack of a plurality of knife blades in a storage chamber. The blade dispenser is designed to be movable from a closed position in conjunction with the housing to an open position. The closed position prevents withdrawal of a knife blade from the dispenser. The open position permits manual withdrawal of a knife blade to be substituted for the blade of usage.

A further embodiment of the present invention is where the first basic embodiment is modified by the blade dispenser being pivotally mounted relative to the housing.

A further embodiment of the present invention is where the first basic embodiment is modified by the housing having a front portion, a rear portion, an upper edge and a lower edge. The blade of usage is mounted within the front portion of the housing and the blade dispenser is mounted within the rear portion of the housing.

A further embodiment of the present invention is where the just previous embodiment is modified by the blade dispenser connecting with the upper edge.

A further embodiment of the present invention is where the just previous embodiment is modified by the blade dispenser being flush with the upper edge and totally confined within the blade storage compartment when in the closed position.

A further embodiment of the present invention is where the first basic embodiment is modified by the blade dispenser having a dispensing opening with the dispensing opening being located closest to the front portion of the housing.

A further embodiment of the present invention is where the first basic embodiment is modified by the blade dispenser having a front plate which is located directly adjacent the dispensing opening with this front plate being deflectable relative to the blade dispenser so as to exert a spring bias against the stack of blades contained within the storage chamber with this spring bias tending to hold the stack of blades in the storage chamber.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figures 1, 2, 3:
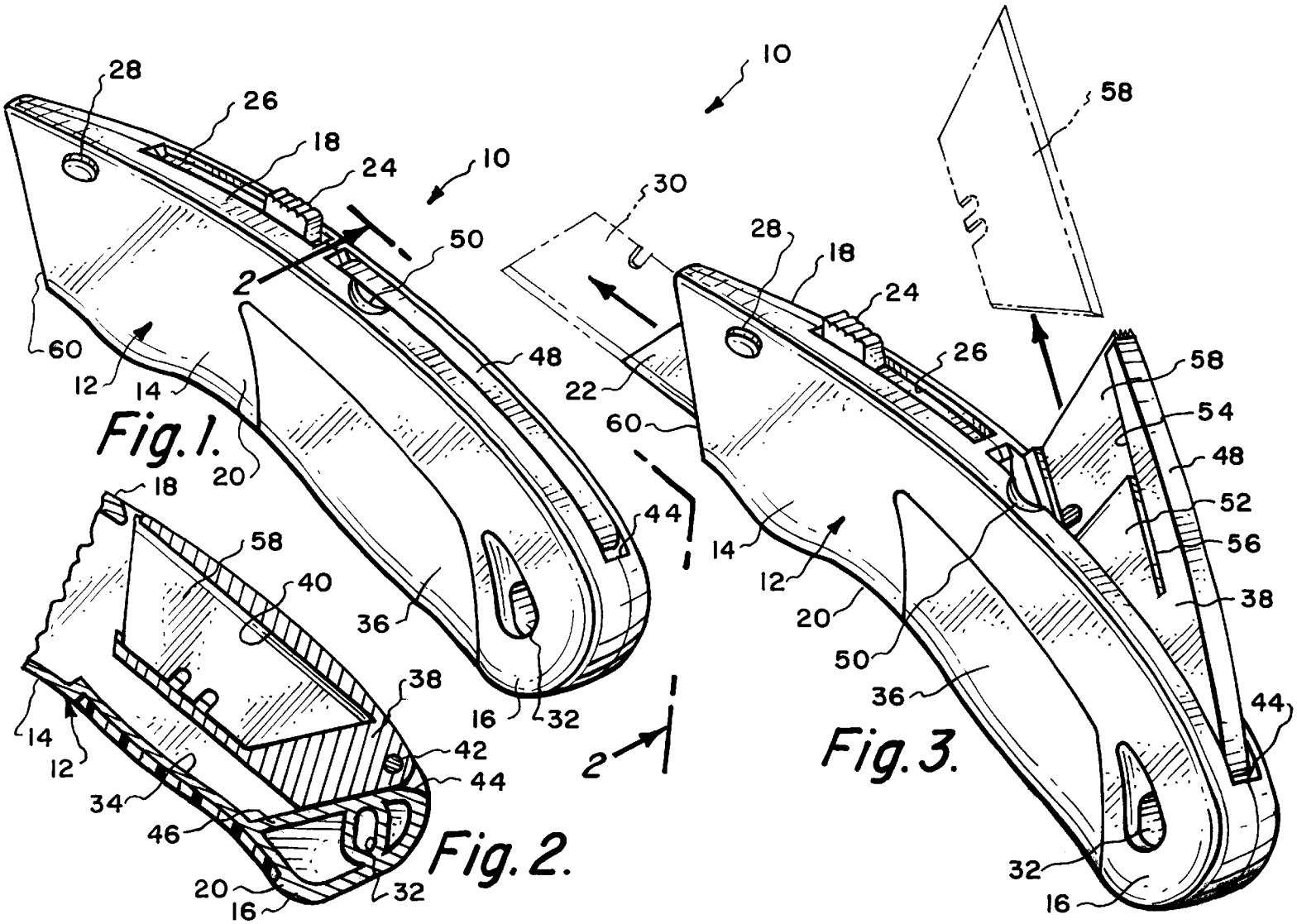
FIG. 1 is an exterior isometric view of the utility knife of the present invention taken from the rear direction of the utility knife and showing the blade dispenser in the closed position.
FIG. 2 is a longitudinal cross-sectional view taken along line 2—2 of FIG. 1 showing in more detail the blade dispenser included within the utility knife of the present invention.
FIG. 3 is an isometric view similar to FIG. 2 but showing the blade dispenser in an open position and depicting removal of a replacement blade and also removal of a blade of usage for which a replacement blade is to be substituted.

Referring particularly to the drawings, there is shown the utility knife 10 of this invention which has an elongated housing 12. The elongated housing 12 is basically of a tubular shape and has a front portion 14, a rear portion 16, an upper edge 18 and a lower edge 20. The front portion 14 includes a single frontal opening, which is not shown, through which is to be extended a blade of usage 22. Extension of the blade of usage 22 is accomplished by an actuator in the form of a slidable member 24 which is mounted within an elongated slot 26 formed within the upper edge 18. Moving of the slidable member 24 from the rear position, shown in FIG. 1, to the forward position, shown in FIG. 3, will result in the blade of usage 22 being moved to an extended position. If it is desired to remove the blade of usage 22 from the utility knife 10, the user only needs to push on button 28 when the blade of usage is in the extended position which will unlock the blade of usage 22 and permit the blade of usage 22 to be manually removed, as is depicted in the dotted line position 30, shown in FIG. 3.

The rear portion 16 includes a through hole 32. The function of the through hole 32 is to facilitate mounting of the utility knife 10 on a nail or other similar type of structure in order to store the utility knife 10 on a wall or panel. The exterior surface of the rear portion 16 includes a rubber or other resilient cover 36. The cover 36 is to facilitate manual grasping and holding of the housing 12 by the user.

Formed within the housing 12 is a blade storage compartment 34. Mounted within the blade storage compartment 34 is a blade dispenser 38. The blade dispenser 38 has a blade storage chamber 40. The blade dispenser 38 is mounted to the housing 12 by means of a pin 42. A small portion of the housing 12, located directly adjacent the pin 42, is relieved to form relief 44. The blade dispenser 38 can be pivoted about the pin 42 from a closed position, shown in FIG. 2, to the open position, shown in FIG. 3. When in the closed position, the interior wall 46 located within the blade storage chamber 34 defines the limit of inward movement of the blade dispenser 38. When the blade dispenser 38 is in contact with the interior wall 46, the top edge 48 of the blade dispenser 38 will be located flush with the upper edge 18 of the housing 12. In essence, a completely solid one-piece structure is shown although the blade dispenser 38 can be manually moved about forty-five degrees to the open position, shown in FIG. 3. This movement is to occur by insertion of one of the user's fingernails in conjunction with recess 50 formed within the top edge 18. The user's fingernail is to come into contact with the blade dispenser 38 when located within the recess 50 which facilitates pivoting of the blade dispenser 38 to the open position. When pivoting to the open position, the relief 44 provides necessary clearance that permits the blade dispenser 38 to be moved to the open position.

The blade dispenser 38 has a front plate 52. Front plate 52 is located directly adjacent a removed wall section which forms a dispensing opening 54. Connecting with the dispensing opening 54 is a slit 56 which is formed within the blade dispenser 38. The slit 56 causes the front plate 52 to be deflectable relative to the housing 38. Upon a stack (usually five in number) of replacement knife blades 58 being located within the storage chamber 40, the front plate 52 will exert a spring bias against the stack of the blades 58 tending to maintain the blades 58 in their established position within the storage chamber 40.

When the blade dispenser is in the open position, as shown in FIG. 3, the user can readily remove one of the knife blades 58 from the stack of blades. That knife blade 58 can be substituted and installed through the opening, which is not shown, formed within the front edge 60 of the front portion 14 of the housing 12. Once the knife blade 58 is installed through the front edge 60, the user is to release button 28 which will lock the blade 58 and now the blade 58 will become the blade of usage 22. Once a blade 58 has been removed from the stack of blades, the blade dispenser 38 is pivoted back to the closed position and the utility knife 10 is to be used as desired.

What is claimed is:

1. A utility knife with blade storage comprising:

a housing;

a blade of usage mounted to said housing, said blade of usage being locatable in an extended position from said housing which is the position of usage, said blade of usage being disengageable from said housing;

a blade storage compartment included within said housing;

a blade dispenser mounted within said blade storage compartment, said blade dispenser adapted to hold a stack of a plurality of knife blades in a storage chamber, said blade dispenser being movable from a closed position to an open position, said closed position preventing withdrawal of said knife blades from said dispenser, said open position permitting manual withdrawal of a knife blade to then be substituted for said blade of usage;

said blade dispenser having a dispensing opening, said dispensing opening being located closest to said front portion; and said blade dispenser having a front plate located directly adjacent said dispensing opening, said front plate being deflectable relative to said blade dispenser so as to exert a spring bias against said stack of blades tending to hold said blades in said storage chamber.

* * * * *